United States Patent [19]

Meshulam et al.

[11] 4,071,952

[45] Feb. 7, 1978

[54] KNIFE AND SAFETY CAP

[75] Inventors: Avram Meshulam, Edison, N.J.; Jerome I. Rebold, Timonium, Md.

[73] Assignee: CBS Inc., New York, N.Y.

[21] Appl. No.: 751,906

[22] Filed: Dec. 17, 1976

[51] Int. Cl.[2] ..... B26B 29/04

[52] U.S. Cl. ..... 30/151; 30/294; 30/296 A

[58] Field of Search ..... 30/151, 286, 295, 294, 30/77, 84, 296 A; 7/15; 145/61 R; 401/98, 202, 213, 244, 262

[56] References Cited

U.S. PATENT DOCUMENTS

| | | | |
|---|---|---|---|
| 1,242,415 | 10/1917 | Benson | 30/151 |
| 2,288,555 | 6/1942 | St. Jacques | 30/151 |
| 2,783,536 | 3/1957 | McQueary | 30/151 |
| 3,080,900 | 3/1963 | Rosenberg | 145/61 R |
| 3,184,782 | 5/1965 | Armour | 401/262 |
| 3,457,643 | 7/1969 | Hill | 30/294 X |
| 3,977,077 | 8/1976 | Rebold | 30/151 |

*Primary Examiner*—Harold D. Whitehead
*Assistant Examiner*—Nicholas P. Godici
*Attorney, Agent, or Firm*—Spencer E. Olson

[57] ABSTRACT

A safety cap for a hand-held cutting knife of the type having a cylindrical handle to one end of which a blade is detachably secured. The cap, formed of transparent plastic material, is shaped and dimensioned to enclose the knife blade and part of the handle for safety when the knife is not in use and to receive and be secured to the rear end of the handle when the knife is in use.

5 Claims, 7 Drawing Figures

KNIFE AND SAFETY CAP

BACKGROUND OF THE INVENTION

This invention relates to hand-held cutting tools, and more particularly to an improved safety cap for a hand-held cutting knife.

Among the many types of hand-held cutting tools commercially available for use by hobbyists and craftsmen such as artists, photographers, draftsmen, etc., is a knife of the type that employs a small blade detachably secured at one end of a cylindrical handle, usually formed of metal and typically about five inches long and five-sixteenths inch in diameter. The knife blade, held in place in a slot in a tapered chuck by tightening a knurled sleeve, is available in a variety of shapes, most of which have an effective width slightly greater than the diameter of the handle; the outer diameter of the knurled sleeve is also slightly larger than the diameter of the handle. The blade being very sharp, it is desirable to protect it when the knife is not in use for the safety of person and property and to also protect the blade itself from damage.

Among the known protective caps for this type of knife is a commercially available protective shield consisting of a hollow transparent plastic cylinder secured to a metal chuck dimensioned to be slidably received on the knife handle and to be secured thereon at an open position when the knife is in use and at a closed position for safety when the knife is not in use. Although this type of shield provides ample protection, it has the disadvantage of increasing the size of the knife body and makes it clumsy to use. Moreover, the shield is relatively difficult and expensive to manufacture. Many users of this type of knife simply insert the blade into a cork for protection, but this safety measure has the disadvantage that the cork deteriorates with repeated use and must be frequently replaced, and it often happens that the cork is misplaced or mislaid while the knife is in use with the consequence that the blade is frequently left unprotected.

It is the primary object of the present invention to provide an improved safety cap for a cutting knife which overcomes the disadvantages of presently available protective and safety devices.

SUMMARY OF THE INVENTION

The present invention is directed to a safety cap for a hand-held cutting knife of the type consisting of a cylindrical handle of uniform diameter throughout the major portion of its length to one end of which a cutting blade is detachably secured by a chuck including a knurled sleeve, the outer diameter of which is slightly larger than the diameter of the handle. In this type of knife the blade is usually slightly wider than the diameter of the knurled sleeve. The safety cap according to the invention is in the form of a tubular housing preferably formed of transparent plastic material, of circular cross-section for about half its length and of flattened rectangular cross-section throughout the remainder of its length, the width dimension of which is equal to the diameter of the circular portion. The housing is open at its circular end and closed at the other end. The inner diameter of the circular portion and the inside width of the rectangular portion are substantially equal to each other and slightly greater than the width of the knife blade to permit the blade to be received by the cap and to enter the rectangular portion. The circular portion has a plurality of circumferentially spaced inwardly directed longitudinally extending bosses formed thereon, the diameter of the circle defined by the innermost surfaces of the bosses being substantially equal to the diameter of the knife handle. To allow entry of the slightly larger diameter knurled sleeve, one or more of the inwardly directed bosses are disposed on a tongue formed by a slot through the wall of the circular portion which provides a spring action to firmly engage the knurled sleeve when the cap is in position over the blade. The cap has external bosses to prevent the knife from rolling off a table or other work surface, whether in position on the rear end of the handle or in its protective position over the blade.

Further features and advantages of the invention will become apparent from the following detailed description taken in conjunction with the accompanying drawings.

DESCRIPTION OF PREFERRED EMBODIMENT

Figure 1:
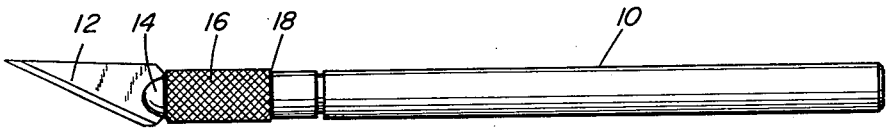
FIG. 1 is a perspective view of a cutting knife with which the protective cap of the invention is intended to be used.

A knife with which the protective cap of the present invention is intended for use, shown full-size in FIG. 1, consists of a handle 10 in the form of a cylindrical rod, usually formed of aluminum, having a uniform diameter of about five-sixteenths inch. A blade 12 is detachably secured to one end of the handle by a chuck including a conical slotted collet 14 threaded into the end of the handle and a knurled sleeve 16, of slightly larger diameter than the handle end, which engages a shoulder 18 on the handle and co-acts with the collet, when the handle is turned relative to the sleeve, to compress the collet and firmly hold the blade in place. The blade 12 is usually slightly wider than the outer diameter of the knurled sleeve 16. Thus, the diameter of a safety cap intended for placement over the blade must have a diameter larger than that of the handle in order to receive the blade and to firmly engage the sleeve; however, a cap having a diameter sufficiently large to receive the blade and knurled sleeve would fall off the handle if placed on the free end thereof when the knife is in use.

Figure 2:
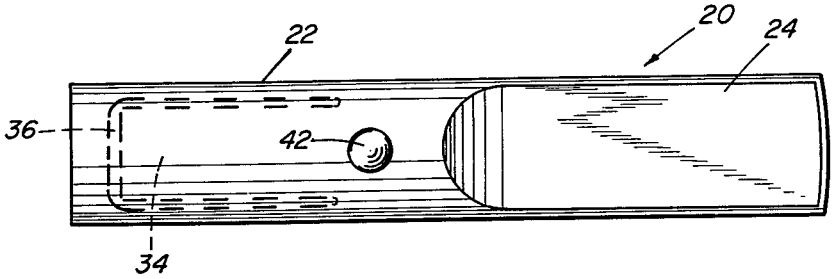
FIG. 2 is a top plan view of the safety cap according to the invention.
Figure 3:
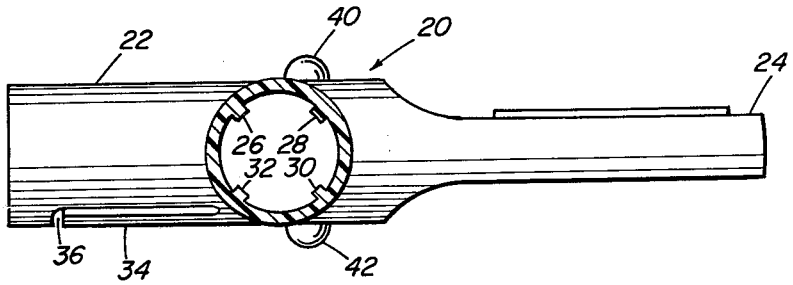
FIG. 3 is a side elevation view of the safety cap.
Figure 4:
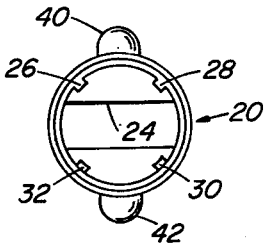
FIG. 4 is an end view of the safety cap as viewed from the left in FIGS. 2 and 3.

The protective cap of the present invention solves the problem of these three conflicting dimensions by the construction shown in FIGS. 2, 3, 4, 6 and 7. The safety cap 20 is preferably formed of a transparent plastic material such as Lexan, as by injection molding, and consists essentially of a one-piece elongated tubular housing, of wall thickness of typically 0.045 inch, consisting of an open-ended circular cross-section portion 22 and a portion 24 of essentially rectangular cross-section, the two portions being of substantially the same length. In the commercial embodiment, the cap has an overall length of two and one-half inches, an outer diameter of 0.47 inch, and the end of the rectangular portion is closed. As best seen in FIG. 2, the width dimension of portion 24 is equal to the diameter of the circular portion 22; its transverse dimension typically is 0.26 inch, less than the diameter of the sleeve 16 of the knife. The described dimensions are sufficiently large to accept the blade 12 of the knife when it is disposed in a plane generally parallel to the wider surfaces of the rectangular portion 24.

In order that the cap may be securely held on the free end of the handle 10 when the knife is in use, the circular cross-section portion 22 of the housing has four circumferentially spaced inwardly directed longitudinally extending bosses 26, 28, 30 and 32 formed thereon. These bosses commence at a point approximately 0.15 inch inwardly from the open end and extend throughout the remainder of the length of the circular cross-section portion. The diameter of the circle defined by the innermost surfaces of the bosses is typically 0.33 inch so as to snugly engage the handle 10. As seen in the cross-sectional view of FIG. 6, the bosses 26–32 are tapered at their outer ends to facilitate insertion of the knife handle. As will be seen in FIGS. 3 and 4, the bosses 26-32 are angularly offset from the plane of the rectangular cross-section portion 24 so as not to interfere with the insertion of the blade which, as has been mentioned, is disposed during insertion in a plane parallel to the wider surfaces of the portion 24. In the preferred embodiment, the bosses are each angularly offset by 45° from a central plane parallel to the width dimension of the rectangular cross-section portion.

Figure 5:
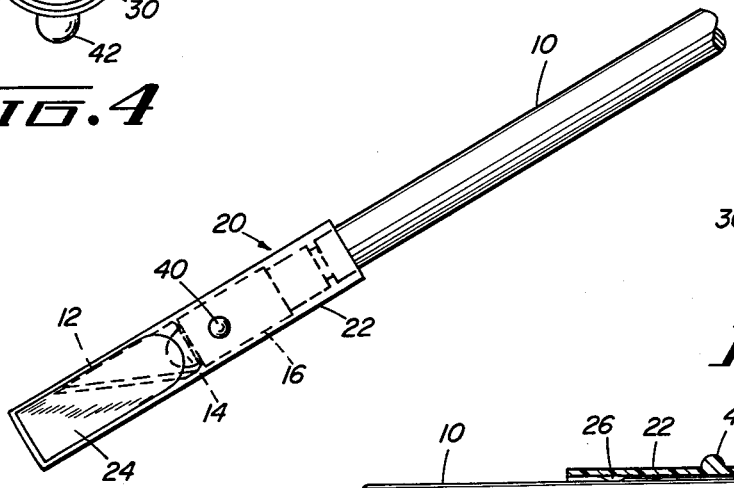
FIG. 5 is a perspective view of a knife with the safety cap of the invention mounted over the knife blade.
Figure 7:
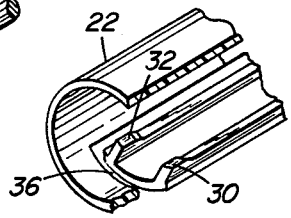
FIG. 7 is a fragmentary view, partially cut away, of the left end of the cap as viewed in FIGS. 2 and 3.
Figure 6:
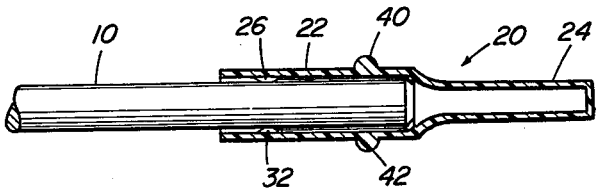
FIG. 6 is a fragmentary view of a portion of a knife with the safety cap mounted on the knife handle.

To enable the knurled sleeve 16 (the outer diameter of which is slightly larger than the diameter of handle 10) to be received by the cap while at the same time providing for a snug fit between the cap and the knurled sleeve when the cap is in place over the blade, the bosses 30 and 32 are carried by a tongue 34 formed in the wall of the circular cross-section portion 22 by a U-shaped slot 36 through the wall. The slot 36 commences at a point approximately 0.15 inch inwardly from the open end and is typically about 0.70 inch long, the resulting tongue 34 having a circumferential dimension to encompass an arc of about 90° so that the bosses 30 and 32 are disposed immediately adjacent the respective long edges of the tongue as shown in FIG. 7. The described material and dimensions give the tongue sufficient springiness to allow entry of the knurled sleeve of the knife into the circular cross-section portion and to firmly engage the sleeve when the cap is in place over the blade. That is, when the knife is fully inserted in the cap, the depth being limited by a height dimension of the portion 24 smaller than the diameter of the sleeve 16, as shown in FIG. 5 the knurled sleeve 16 is located well inwardly from the outer end of slot 36 to thereby firmly hold the cap in place. Further gripping power is provided by protrusions at the outer ends of bosses 30 and 32 which extend radially inward a slightly greater distance than do the remainder of the length of these bosses.

The flat surfaces of the rectangular cross-section portion 24 facilitate gripping of the cap between the thumb and forefinger to pull the cap from the knife, and offer the further advantage of providing a surface for carrying the name of the manufacturer or other information; such information can readily be integrally molded with the cap.

A pair of bosses 40 and 42 of generally hemispherical shape are provided on the external surface of the circular cross-section portion 22 near the transition from circular to rectangular. These bosses, which typically have a radius of 0.07 inch, are located on diametrally opposite sides of the circular cross-section portion, in a plane generally perpendicular to the plane of the width dimension of the rectangular portion 24. These bosses, whether the safety cap is in its protective position over the blade or carried on the free end of the handle, prevent rolling of the knife, thereby helping to prevent inadvertent injury to person, to property, or to the knife itself. The transparency of the cap further contributes to safety in that it permits the blade to be seen to thereby warn the user to exercise care in removing the safety cap.

Although a specific embodiment of the safety cap has been described, it will be understood that various changes and modifications can be made without departing from the spirit of the invention. For example, the cap may be formed of materials other than Lexan, including opaque materials, and the dimensions may be changed from those of the described embodiment as appropriate to render the cap amenable for use with knives of the kind described but of different size.

We claim:

1. In a cutting device having a rod-like handle of substantially uniform diameter for most of its length, and a cutting blade slightly wider than the diameter of the handle secured to one end of said handle by a chuck which includes a knurled sleeve having an outer diameter slightly larger than the diameter of the handle, the improvement consisting of a safety cap adapted to be firmly held either over the cutting blade or to the other end of the handle, said safety cap comprising:

an elongated tubular housing having a circular cross-section for about one-half its length of a diameter slightly larger than the diameter of said handle and a rectangular cross-section for the remainder of its length, said housing being open at its circular cross-section end and closed at the other end, the width dimension of said rectangular cross-section portion being substantially equal to the diameter of said circular cross-section portion and slightly larger than the width of the cutting blade, said circular cross-section portion having a plurality of narrow circumferentially spaced inwardly directed longitudinally extending bosses formed on the inner wall thereof, the innermost surfaces of which define a circle having a diameter substantially equal to the diameter of said handle, at least one of which bosses extends radially inward from an elongated flexible tongue formed in and constituting part of the wall of said circular cross-section portion, said inwardly directed longitudinally extending bosses firmly engaging said knurled sleeve and said rectangular cross-section portion receiving and covering said cutting blade when the safety cap is placed over the cutting blade, and said inwardly extending bosses firmly engaging said other end of the handle when said other end of the handle is inserted in the open end of said circular cross-section portion.

2. Device according to claim 1, wherein four inwardly directed longitudinally extending bosses are circumferentially spaced one from the next by about 90° and each inwardly extending boss is angularly displaced by about 45° from a plane disposed between and parallel to the wider surfaces of said rectangular cross-section portion, and wherein two adjacent ones of said bosses extend inwardly from respective edges of said flexible tongue.

3. Device according to claim 2, wherein said housing is formed of transparent plastic material, whereby the cutting blade is visible when covered by the safety cap.

4. Device according to claim 3, wherein said housing has at least one outwardly extending boss formed on the outer wall of said circular cross-section portion for inhibiting rolling of the cutting device.

5. Device according to claim 4, wherein said housing has two hemispherical bosses formed at diametrically opposite locations on the outer wall of said circular cross-section portion for preventing rolling of the cutting device.

* * * * *